United States Patent [19]

Cocks et al.

[11] Patent Number: 4,488,665

[45] Date of Patent: Dec. 18, 1984

[54] MULTIPLE-OUTLET ADHESIVE APPLICATOR APPARATUS AND METHOD

[75] Inventors: Eric H. Cocks, Fort Lauderdale; Richard A. Griffin, Pompano Beach, both of Fla.

[73] Assignee: Spraymation, Inc., Fort Lauderdale, Fla.

[21] Appl. No.: 381,519

[22] Filed: May 24, 1982

[51] Int. Cl.[3] ..... B67D 5/62

[52] U.S. Cl. ..... 222/146.5; 222/189; 222/504; 222/482; 118/313

[58] Field of Search ..... 222/1, 146 HE, 146 H, 222/189, 330, 331, 504, 481, 482; 118/313, 315, 411, 412; 239/562, 567, 565, 551, 556; 68/200, 203, 205 R

[56] References Cited

U.S. PATENT DOCUMENTS

| | | | |
|---|---|---|---|
| 2,804,764 | 9/1957 | Runton | 118/313 |
| 3,061,102 | 10/1982 | Mayer | 222/189 |
| 3,585,361 | 6/1971 | Rosen et al. | 222/146 HE |
| 3,690,518 | 9/1972 | Baker et al. | 222/504 |
| 3,811,601 | 5/1974 | Reighard et al. | 222/504 |
| 4,157,149 | 6/1979 | Moen | 222/330 |
| 4,247,047 | 1/1981 | Schaming | 239/556 |

*Primary Examiner*—H. Grant Skaggs
*Attorney, Agent, or Firm*—Richard M. Saccocio

[57] ABSTRACT

Apparatus and a method for applying coextensive lines or dots of an adhesive comprising an airless, solenoid-operated, adhesive spray applicator having a plurality of individual applicators within a single housing including a flow distribution arrangement, and a transverse, internally-mounted filter. The filter may be removed and replaced without disturbing the flow lines. Virtually any spray pattern may be applied by staggering rows of applicators and electronically controlling the operation of the individual applicators.

9 Claims, 4 Drawing Figures

MULTIPLE-OUTLET ADHESIVE APPLICATOR APPARATUS AND METHOD

BACKGROUND OF THE INVENTION

1. Field of the Invention

This invention relates in general to the field of applicators for applying an adhesive and in particular to apparatus for applying multiple lines of adhesives in commercialized, assembly-line operations.

2. Description of the Prior Art

In commercial applications, where an adhesive is applied to various products such as paper cartons, diapers, paper towels, bathroom tissue, or other like products, it is typical that automatic adhesive spray applicators be used to apply the adhesive. In such applications, the adhesive may be in the form of small dots, thin dashed or solid lines, large dots, or broad dashed or solid lines. The lines or dots are usually applied in a direction coincident with the direction of travel of the product as it travels past the fixed position of the adhesive applicator. In the event a series of multiple parallel lines or dots of adhesive are required to be applied, a number of adhesive applicators may be "ganged" together.

In the early history of the prior art, the adhesive applicators were air actuated whereby a built-in air cylinder is used to lift a shutoff needle from a seat to permit the dispensing of a pressurized adhesive. Air-operated actuators have been found to be inherently disadvantageous in applying adhesives in commercial applications. For example, they are not sufficiently responsive for high-speed production where their use results in misapplication of the amount of the adhesive and mislocation of the placement of the adhesive. If the adhesive is misplaced or applied at the wrong location, the product may be spoiled and perhaps be rejected as unsatisfactory. Similarly, if insufficient adhesive is applied, the glued joint may be weaker than required. If an attempt is made to overcome an insufficiency of adhesive by applying additional adhesive at additional locations where such additional locations are not critical to the product, the cost of such additional adhesive may unnecessarily and materially add to the cost of production. Thus, for every application there is an optimum condition of applying the exact amount of adhesive at the desired location. Such applications require apparatus which dispenses an adhesive and which responds accurately and repeatedly to input control signals.

Attempts have been made to overcome the inherent disadvantages in air-operated applicators by the use of sophisticated electronic equipment to operate solenoid valves for purposes of controlling the air used to operate the applicator; however, such attempts have not in general been satisfactory. Electronic control of the air still resulted in a time delay between the operation of the valve and the subsequent operation of the air cylinder of the applicator. The time delay is not consistent and will vary inasmuch as sealing packings within the applicator change characteristics with heat and use causing inconsistencies in application of the adhesive when responding to the same signal.

The use of airless, solenoid-operated adhesive spray applicators have substantially overcome the problems of the air-operated applicators. In such applicators, the adhesive is applied without the use of compressed air. Upon activation, a solenoid unseats a spring-loaded plunger which then permits a pressurized adhesive to flow past the valve and onto the product. The airless, solenoid-operated applicator shown and described in U.S. Pat. No. 3,212,715, issued Oct. 19, 1965, by Eric H. Cocks, and its progeny have been shown to be immensely successful in overcoming the problems associated with air-actuated applicators.

The need for stronger, adhesively-bonded joints and/or smaller applications of an adhesive brought about the use of hot-melt adhesives as contrasted with cold adhesives which are in a liquid form at room temperature. Hot-melt adhesives liquify when heated from 200° F. to 500° F; at room temperature they are in a solid form. The aforementioned problems associated with air-actuated applicators became more acute with their use with hot-melt adhesives. The heat needed to maintain the glue in a liquid state prior to and during dispensing made the operation of the air-actuated applicators even more erratic. On the other hand, the airless, solenoid-operated applicator, invented by Eric H. Cocks, was quite adaptable for use with hot-melt adhesives. U.S. Pat. Nos. 3,485,417, issued Dec. 23, 1969, "Hand-Held Applicator for Hot-Melt Adhesives", 3,408,008, issued Oct. 29, 1968, "Apparatus for Applying Hot-Melt Adhesives", and 3,662,927, issued May 16, 1972, "Hot-Melt Adhesive Systems", all by Eric H. Cocks, disclose some of the innovations that Mr. Cocks has made in the field of hot-melt adhesive applicators and apparatus associated therewith and are typical of the state of the prior art.

As might have been expected, the commercialization of the use of adhesives continued to grow. Such growth has, in part, been brought about by the improvements in the equipment used to dispense the glue as previously described in my United States patents relating thereto. Presently, applications involving closely-spaced, multiple lines or dots of adhesive are being used with increasing frequency. And, as might also have been expected, it is desirable in these applications to obtain the benefits of a hot-melt adhesive.

In attempting to provide apparatus to fulfill the requirements associated with multiple-line applications, a number of single applicators have been "ganged" and in another attempt, multiple dispensing heads have been adapted to a single applicator. Neither prior-art attempted solution has been singularly satisfactory. A failure of one or more of the ganged applicators caused assembly-line shutdowns. Moreover, the probability of at least one failure was quite high. The attempt to use a multiple spray head with a single applicator is also not satisfactory in that it is very difficult to achieve consistent adhesive flow through the multiple head. As a result, most presently known multiple-line applicators utilize the inherently disadvantageous air-operated applicator. The inventor herein knows of no prior art whereby an airless, solenoid-operated applicator is used in conjunction with closely-spaced multiple-line applications.

Accordingly, a primary object of the present invention is to provide multiple outlet adhesive applicator apparatus which applies closely-spaced lines or dots of an adhesive which is not operated by compressed air.

Another object of the present invention is to provide multiple outlet adhesive applicator apparatus which is capable of applying high viscosity, hot-melt adhesives by fast-acting applicators with precision, accuracy and repeatability.

Still another object of the present invention is to provide multiple outlet adhesive applicator apparatus for either cold or hot-melt adhesives which is directly solenoid actuated.

Still another object of the present invention is to provide multiple outlet adhesive applicator apparatus which allows for quick replacement of one or more of the multiple applicator outlets to reduce assembly-line down time.

A further object of the present invention is to provide multiple outlet adhesive applicator apparatus which is virtually leakfree and noncloggable.

Another object of the present invention is to provide multiple-outlet adhesive applicator apparatus which provides a means for filtering a liquid adhesive which allows for removal and replacement of a filter without disturbing any flow lines associated with the adhesive dispensing apparatus.

Another object of the present invention is to provide a flow arrangement for a multiple-outlet adhesive applicator which simultaneously supplies a heated, liquified adhesive to each of the multiple outlets.

Another object of the present invention is to provide multiple-outlet adhesive applicator apparatus which is capable of applying virtually any desired pattern of lines or dots of adhesive without regard to the physical limitation of the spacing between individual applicators.

SUMMARY OF THE INVENTION

The present invention comprises an adhesive spray applicator having one or more individual, airless, solenoid-operated spray applicators mounted to a single housing. The one or more individual applicators are supplied with a liquid adhesive through a single inlet. Flow channels within the housing distribute the flow of adhesive from the inlet to the individual applicators. A transverse mounted filter, within the housing, allows removal and replacement of the filter without having to disturb the adhesive flow lines to or within the applicator.

Various other objects, advantages and features of the invention will become apparent to those skilled in the art from the following discussion taken in conjunction with the following drawings, in which:

DESCRIPTION OF THE PREFERRED EMBODIMENTS

Figure 1:
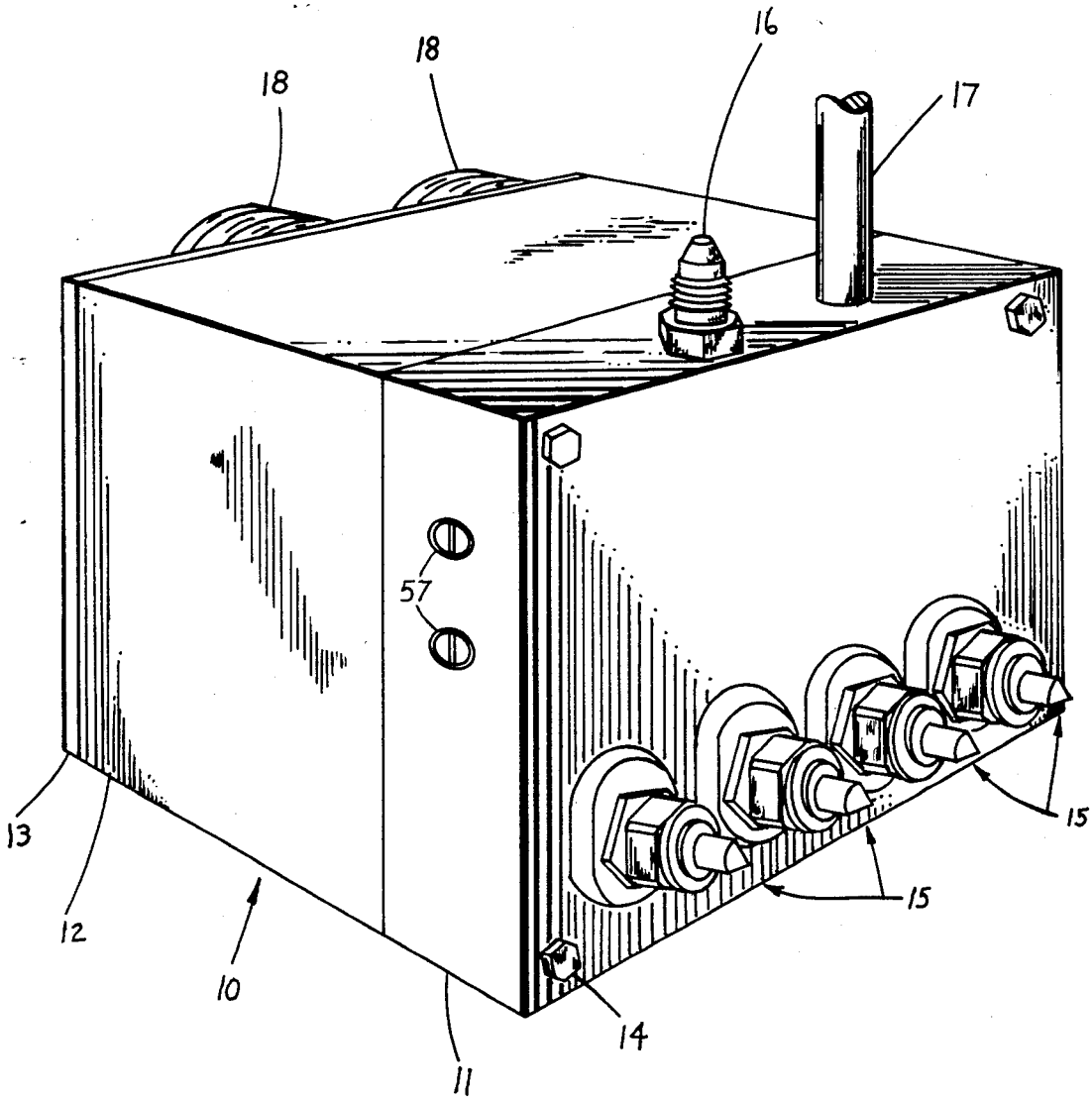
FIG. 1 is an isometric view of a multiple outlet adhesive applicator made in accordance with the invention.

Referring now to the drawings, specifically to FIG. 1 which depicts one embodiment of a multiple-outlet adhesive applicator made in accordance with the invention herein. A housing 10 may consist of a front 11, a middle 12 and a back 13 portion. Front 11 and middle 12 portions are connected together such as by bolts 14. Back portion 13 may be similarly bolted to middle portion 12. One row of one or more individual adhesive spray applicators or outlets 15 are mounted to housing 10 in such a manner as to achieve a desired pattern of adhesive applications. Although four individual applicators 15 in one row are shown, the invention is not to be limited thereby. Any number of individual applicators 15 or rows may be used. An adhesive inlet fitting 16 is also mounted to housing 10 which provides for the inlet flow of an adhesive to the multiple outlet applicator. Mounting bar 17 provides a means to mount housing 10 to an appropriate assembly line fixture. Connector halves 18 are provided for electrical connection purposes and may comprise simple fittings through which electrical wiring into and out of housing is ducted or may comprise a pin type of connector to which is soldered the wiring from within the housing.

Figure 2:
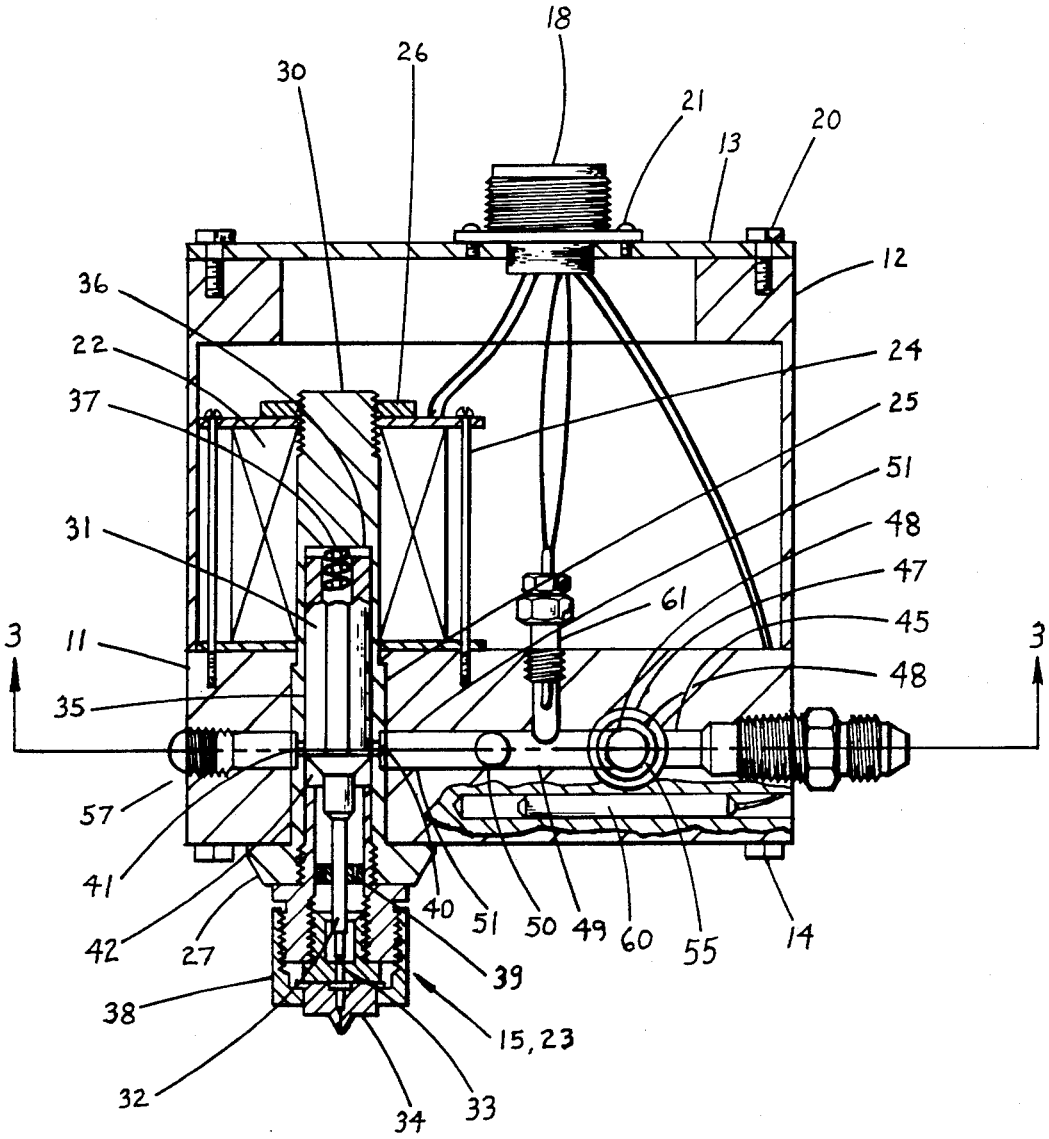
FIG. 2 is a cross-sectional view of the applicator of FIG. 1 taken through the body thereof illustrating the details of a typical applicator outlet and the adhesive flow arrangement for supplying an adhesive to the applicator outlet.

FIG. 2 is a cross-sectional side view of the embodiment of FIG. 1. Bolts 20 may be used to connect back portion 13 to middle portion 12 of housing 10. Screws 21 fasten connector half 18 to back portion 13. Each individual applicator 15 comprises a solenoid coil 22 and a fluid dispensing module assembly 23. Solenoid coil 22 is attached to front portion 11 such as by screws 24. Fluid dispensing assembly 23 fits within an opening 25 through front portion 11 and extends through solenoid coil 22. Nut 26 in conjunction with flange 27 secures fluid dispensing assembly 23 to housing 10 and solenoid coil 22. Thus, in the unlikely event of a failure within fluid dispensing assembly 23, the entire assembly 23 may be removed by removing back portion 13 and nut 26 which permits assembly 23 to be withdrawn from opening 25. In this manner, there is no need to take production time to attempt to discover the exact cause of the failure within fluid dispensing assembly 23 and then to attempt to correct the same, nor is it required to remove the entire housing from its operating position to correct the internal malfunction. Once a new fluid dispensing assembly 23 is installed, production may again commence. The defective unit may then be serviced in the convenient and relatively casual atmosphere of a workshop and then stored for future use. In this manner, production downtime is minimized.

Fluid dispensing assembly 23, in part, includes an elongated outer member 30 (which includes flange 27), a plunger 31 having needle 32 attached thereto, an orifice 33 and a nozzle 34. Plunger 31 is slidingly engaged within a blind hole 35 within member 30. The bottom surface 36 of blind hole 35 serves as a stop for plunger 31. Spring 37 maintains plunger 31 away from stop 36 and keeps needle 32 against orifice 33, which as will be explained more fully hereinafter, is a nonflow position. Nozzle 34, which is mounted downstream of orifice 33, is in flow communication with orifice 33 and is secured thereto by retaining nut 38. Nozzle 34 typically shapes or contours the flow of adhesive and controls the amount of adhesive sprayed or applied. Guide busing 39 may be used to further guide the sliding movement of needle 32 to assure positive mating of the top of needle 32 with orifice 33.

A groove 40 around the outer periphery of member 30 and one or more holes 41 drilled radially from groove 40 to hole 35 provides for adhesive flow communication from groove 40 through hole 35 to fluid cavity 42. Fluid cavity 42 comprises the space surrounding needle 32 and within opening 35 and bushing 43. Upon activation of solenoid coil 26, by supplying electrical energy thereto, plunger 31 is magnetically drawn towards and against stop 36 thereby disengaging the tip of needle 32 away from orifice 33 and permitting adhesive, which is pressurized by conventional means, to flow through from groove 40 to orifice 33 and through nozzle 34. Deactivation of solenoid coil 26 allows spring 37 to return plunger 31 and hence the tip of needle 32 back up against orifice 33 so as to shut off flow of the adhesive. Applicator 15 is thus again in a shutoff positive awaiting another electrical signal to dispense yet another controlled amount of adhesive in a pattern and amount dictated by nozzle 34.

Figure 3:
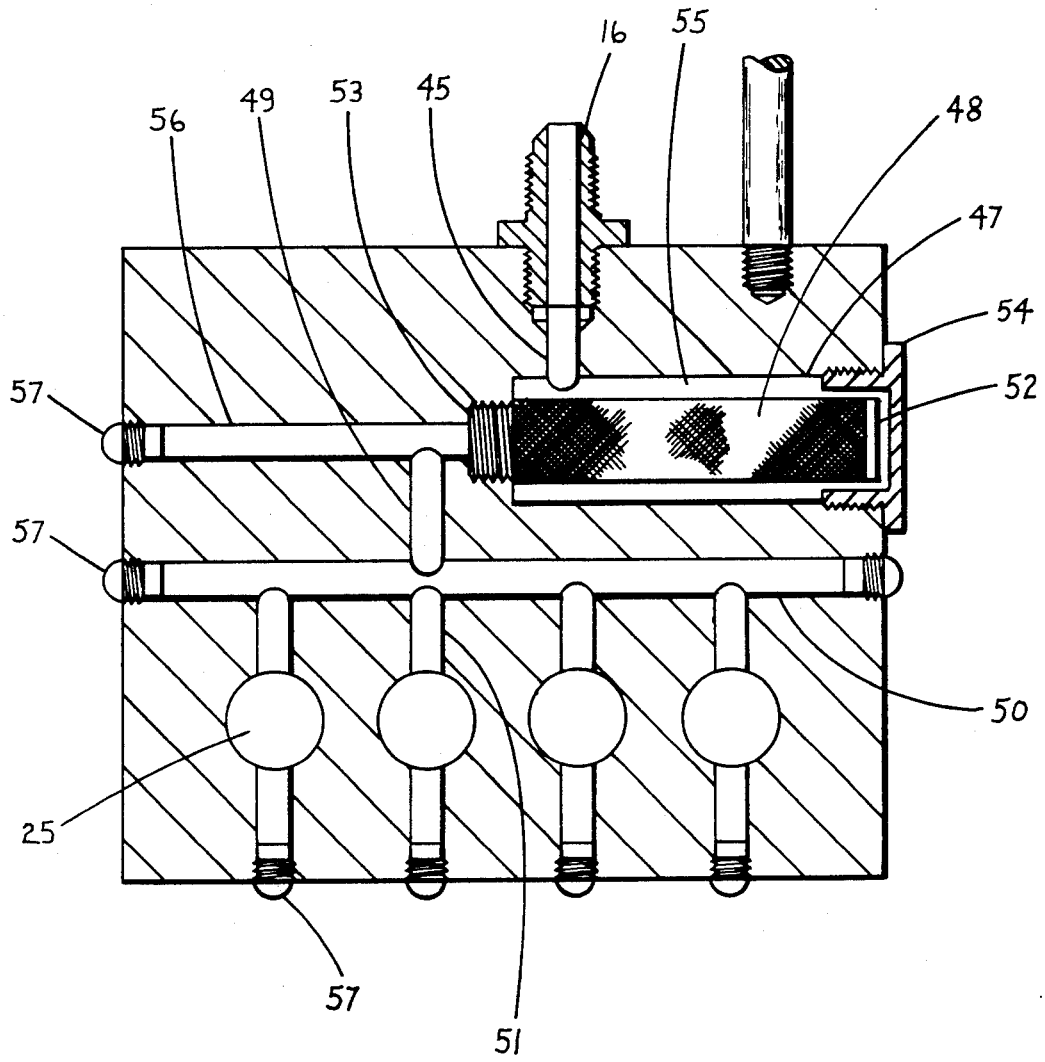
FIG. 3 is a cross-sectional view of the applicator of FIG. 2 taken along the line 3—3 thereof further illustrating the adhesive flow arrangement therewithin; and, FIG. 4 illustrates two patterns of adhesive which may be laid down by the inventive applicator.

Front portion 11 of housing 10 provides for the flow of adhesive from inlet 16 to each of the individual applicators 15. Additionally, means are provided to filter the adhesive prior to the same being distributed to the individual applicators 15. Referring to FIGS. 2 and 3, it is seen that flow channel 45 is axially aligned with inlet 16 and is perpendicularly aligned with channel 47. A filter 48 fits within channel 47. Flow channels 49 and 51 are also perpendicularly aligned with channel 47. Flow channel 50 flow connects channels 49 and 51. Inlet 16 and flow channel 45 are flow connected to the outside of filter 48; while, groove 40 (the inlet to applicator 15), flow channel 51, flow channel 50 and flow channel 49 are flow connected to the inside of filter 48.

Filter 48 may comprise a fine mesh screen made from stainless steel or other appropriate material formed into a cylinder having a sealed cap 52 at one end and a threaded connector 53 at its other end. Filter 48 fits within hole 47 and is seal connected therein by threaded connector 53 and threaded cap 54 such that an annular cavity 55 exists external of filter 48. Inlet 16 and flow channel 45 are flow connected to annular cavity 55. Hence, adhesive fluid entering through inlet 16 is channeled to cavity 55 and is then filtered upon passing through the cylindrical surface of filter 48. Flow channel 56 is in flow communication with the filtered adhesive fluid internal of filter 48 and with flow channel 49. Distribution flow channel 50 provides flow communication of filtered adhesive from channel 49 to channels 51 which directly provide for adhesive flow to grooves 40 of individual applicators 15.

The unique arrangement described above provides filtration means which allows for removal and replacement of the filter element 48 without disturbing the flow inlet 16 or any connections associated therewith which duct the adhesive to housing 10 and without disturbing individual applicators 15. To remove filter element 48, threaded cap 54 is removed and element 48 is unthreaded at end 53 from housing 10. A new filter element 48 is inserted by utilizing a reverse procedure. By comparison, an in line filter would require disturbing the inlet flow lines to the housing. Other advantages gained by the inventive filtration means can well be appreciated by one skilled in the art.

Flow channels 50 and 56 are drilled through the entire length of front portion 11 of housing 10 consistent with economical machining practices. Such machining, however, requires threaded end plugs 57 to maintain the sealed integrity of the flow arrangement. In the alternative, the ends of channels 50 and 56 may be sealed by plug welding. Flow channel 51 may be similarly machined and seal plugged.

Referring again to FIG. 2, a heating element 60 is imbedded within front portion 11 in a manner which is well known in the art. Heating element 60 is appropriately controlled by a sensing element 61 so as to maintain the adhesive at a preset temperature. Sensing element 61, which may be a thermistor, may also be imbedded within front portion 11 or may be in direct contact with the adhesive fluid. The latter arrangement is shown in FIG. 2.

Figure 4:
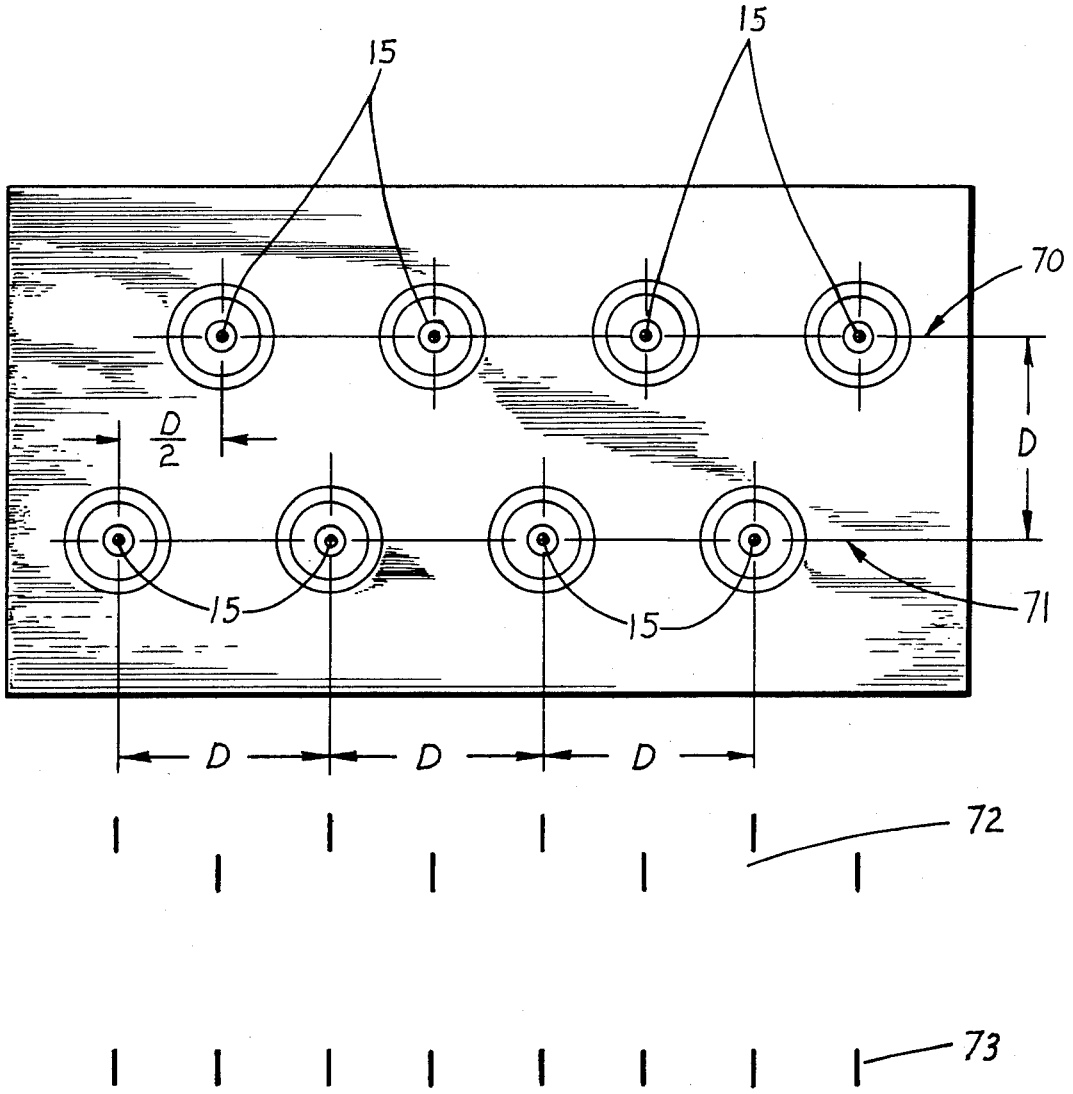

FIG. 4 illustrates a method whereby the inventive multiple outlet adhesive applicator can be utilized to apply lines of adhesive closer together than the physical spacing between individual spray applicators 15. FIG. 4 further illustrates an arrangement whereby laid-down lines or dots of adhesive are spaced apart by a distance equal to one-half of the center-to-center distance D of side-by-side applicators 15. In this arrangement, a second row 71 of individual applicators 15 are provided in front portion 11. The second row 71 is placed below the first row 70 but offset relative to the first row 70 by one-half the distance D between applicators 15. If all the individual applicators 15 were simultaneously actuated, the lines or dots of adhesive laid down would be spaced in rows as shown at 72. However, by timing the sequence of operation by first activating row 70 and then, after a short but discrete time, by activating row 71, a line or dots of adhesive can be laid down in a single row as shown at 73. Although not shown, it can be appreciated that additional rows of individual applicators 15 can be added to further decrease the distance between laid-down lines of adhesive. And, by programming the sequence of operation of applicators 15, a virtually unlimited number of patterns of lines or dots of adhesive may be applied.

While the invention has been described, disclosed, illustrated and shown in certain terms or certain embodiments or modifications which it has assumed in practice, the scope of the invention is not intended to be nor should it be deemed to be limited thereby and such other modifications or embodiments as may be suggested by the teachings herein are particularly reserved especially as they fall within the breadth and scope of the claims here appended.

We claim as our invention:

1. Apparatus for dispensing a plurality of coextensive lines or dots of an adhesive comprising:

a housing;

a plurality of adhesive applicators mounted to said housing, each applicator comprising a solenoid coil, an adhesive dispensing module and means connecting said module to said housing and to said coil for removing and replacing each of said modules as a single unit;

an adhesive inlet flow channel within said housing;

an adhesive distribution flow channel within said housing connected to said inlet flow channel and to each of said plurality of applicators; and, a filter interposed between said inlet flow channel and said distribution flow channel, said filter comprising a cylindrical fine mesh screen sealingly capped at one end and open at its other end, and means for removing and replacing said filter without disturbing said inlet and distribution flow channels comprising said open end being removably connected to an outlet flow channel within said housing with said filter fitting within an opening in said housing forming an annulus between said filter opening and said cylindrical screen, said annulus being flow connected to said adhesive inlet flow channel, said outlet flow channel being flow connected to said distribution flow channel, and a cap sealingly and removably connected to said filter opening in said housing.

2. The apparatus of claim 1, wherein said module connecting means comprises a colinear opening through said housing and said coil with said module fitting within said opening and secured at one end by a flange and at its other end by a mechanical fastener.

3. The apparatus of claim 2, wherein said mechanical fastener comprises a nut threadingly engaged to threads on said module.

4. The apparatus of claim 1, wherein said housing comprises a shell having a front portion and a rear portion removably attached thereto, with said inlet, said distribution flow channel and said filter being located within said front portion.

5. The apparatus of claim 4, wherein said plurality of adhesive applicators are mounted substantially perpendicular to said front portion forming one or more rows along an outside face of said front portion.

6. The apparatus of claim 4, wherein said plurality of adhesive applicators are mounted substantially perpendicular to said front portion forming a plurality of rows along an outside face of said front portion with each of said rows of adhesive applicators being aligned relative to each other forming a plurality of columns of applicators.

7. The apparatus of claim 6, wherein at least one of said rows of adhesive applicators is offset relative to another row of adhesive applicators.

8. The apparatus of claim 1, including means for measuring the temperature of said adhesive flowing within said housing.

9. The apparatus of claim 1 including means for heating said adhesive flowing within said housing.

* * * * *